US007319771B2

(12) United States Patent
Åsnes

(10) Patent No.: US 7,319,771 B2
(45) Date of Patent: Jan. 15, 2008

(54) VIBRATOR FOR BONE CONDUCTED HEARING AIDS

(75) Inventor: Kristian Åsnes, Mölndal (SE)

(73) Assignee: P & B Research AB, Göteborg (SE)

( * ) Notice: Subject to any disclaimer, the term of this patent is extended or adjusted under 35 U.S.C. 154(b) by 776 days.

(21) Appl. No.: 10/296,977

(22) PCT Filed: May 31, 2001

(86) PCT No.: PCT/SE01/01227

§ 371 (c)(1),
(2), (4) Date: Jun. 17, 2003

(87) PCT Pub. No.: WO01/93633

PCT Pub. Date: Dec. 6, 2001

(65) Prior Publication Data

US 2004/0028249 A1 Feb. 12, 2004

(30) Foreign Application Priority Data

Jun. 2, 2000 (SE) ..... 0002073

(51) Int. Cl.
*H04R 25/00* (2006.01)
*H04R 1/28* (2006.01)

(52) U.S. Cl. ..... 381/326; 381/322; 381/412

(58) Field of Classification Search ..... 600/25; 607/55–57; 381/152, 322, 326, 380, 396, 381/400, 401, 406, 407, 412–415, 417, 418, 381/420

See application file for complete search history.

(56) References Cited

U.S. PATENT DOCUMENTS 905,781 A 1/1908 Baldwin
2,500,541 A * 3/1950 Greibach ..... 381/151
4,498,461 A 2/1985 Hakansson (Continued)

FOREIGN PATENT DOCUMENTS

SE 431705 2/1984

(Continued)

OTHER PUBLICATIONS

P. Carlsson, On Direct Bone Conduction Hearing Devices, Advances in Transducer Technology and Measurement Methods, Technical Report 195, Dept. of Appl. Electronics, Chalmers University of Technology, Mar. 1990, Papers C and D.

(Continued)

*Primary Examiner*—Brian Ensey
(74) *Attorney, Agent, or Firm*—Venable LLP; Eric J. Franklin

(57) ABSTRACT

A vibrator for a bone conduction type hearing aid device. The vibrator includes a coil for generating a dynamic magnetic field and two permanent magnets for generating a static magnetic field. The two permanent magnets are working independently from each other in the magnetic circuit and an arranged in such a way that the static and dynamic magnetic fields are substantially separated from each other, but coinciding in the air gaps formed between the coil and magnet arrangement and the casing, whereby the vibrator provides an axial force.

16 Claims, 9 Drawing Sheets

U.S. PATENT DOCUMENTS

| | | | | |
|---|---|---|---|---|
| 4,606,329 | A | | 8/1986 | Hough |
| 4,904,233 | A | | 2/1990 | Håkansson et al. |
| 4,988,333 | A | | 1/1991 | Engebretson et al. |
| 5,282,858 | A | | 2/1994 | Bisch et al. |
| 5,318,502 | A | | 6/1994 | Gilman |
| 5,411,467 | A | | 5/1995 | Hortmann et al. |
| 5,562,670 | A | | 10/1996 | Brånemark |
| 5,800,336 | A | * | 9/1998 | Ball et al. ..... 600/25 |
| 5,812,598 | A | | 9/1998 | Sharma et al. |
| 5,897,486 | A | | 4/1999 | Ball et al. |
| 5,913,815 | A | | 6/1999 | Ball et al. |
| 5,951,601 | A | | 9/1999 | Lesinski et al. |
| 6,053,920 | A | | 4/2000 | Carlsson et al. |
| 2003/0034705 | A1 | | 2/2003 | Hakansson |

FOREIGN PATENT DOCUMENTS

| | | |
|---|---|---|
| SE | 447 948 | 12/1986 |
| WO | 97/09858 | 12/1998 |
| WO | 99/09785 | 2/1999 |
| WO | 00/10361 | 2/2000 |
| WO | 01/93635 | 12/2001 |

OTHER PUBLICATIONS

S. Stenfelt, Hearing by Bone Conduction, Physical and Physiological Aspects, Chalmers, Tech. Rpt. 358, Mar. 1999, pp. 1-51.

* cited by examiner

VIBRATOR FOR BONE CONDUCTED HEARING AIDS

CROSS-REFERENCES TO RALATED APPLICATIONS

This application claims priority to Swedish patent application 0002073-5 filed 2 Jun. 2000 and is the national phase under 35 U.S.C. § 371 of PCT/SE01/01227 filed 21 May 2001.

FIELD OF THE INVENTION

The present invention relates to a vibrator for hearing aid devices of the bone conduction type, ie hearing aid devices by which the sound information is mechanically transmitted via the skull bone directly to the inner ear of a person with impaired hearing. The vibrator can be used for traditional, bone anchored as well as implanted bone conduction hearing aid devices.

BACKGROUND OF THE INVENTION

For persons with impaired hearing, the hearing aid devices which are mainly used today are those based on the principle that the sound is amplified and fed into the auditory meatus and stimulates the eardrum from the outside. In order to prevent feedback problems in these devices, the auditory meatus is almost completely plugged by a hearing plug or by the hearing aid device itself. This causes the user a feeling of pressure, discomfort, and sometimes even eczema. In some cases it even causes the user problems like running ears due to chronic ear inflammations or infections in the auditory canal. p For persons who cannot benefit from traditional, air conduction hearing aids due to such problem that have been described here it is previously known to use hearing aids which leave the auditory meatus free, see for instance U.S. Pat. No. 5,411,467 and U.S. Pat. No. 5,318,502 which hearing aids are both connected to the middle ear. Such a connection, however, requires a surgical operation in the middle ear which is a relatively complicated procedure.

By U.S. Pat. No. 5,282,858 and U.S. Pat. No. 4,988,333 it is also previously known to install a part of the hearing aid device on the middle ear bones. Although such a solution leaves the auditory meatus free, it nevertheless requires an extensive surgical installation procedure on the middle ear bones. These types of hearing aids have therefore not been used so much.

However, there are other types of sound transmitting hearing aids on the market, i e bone anchored hearing aids which mechanically transmit the sound information to a persons inner ear via the skull bone by means of a vibrator. The hearing aid device is connected to an implanted titanium screw installed in the bone behind the ear and the sound is transmitted via the skull bone to the cochlea (inner ear), i e the hearing aid works whether there is a disease in the middle ear or not. The bone anchoring principle means that the skin is penetrated which makes the vibratory transmission very efficient.

This type of hearing aid device has been a revolution for the rehabilitation of patients with certain types of impaired hearing. It is very convenient for the patient and almost invisible with normal hair styles. It can easily be connected to the implanted titanium fixture by means of a bayonet coupling or a snap in coupling. One example of this type of hearing aid device is described in U.S. Pat. No. 4,498,461 and it is also referred to the BAHA® bone anchored hearing aid marketed by Entific Medical Systems in Göteborg.

Even if the bone conduction hearing aid devices have made it possible for more people to benefit from a satisfactory hearing aid, there are also problems with this type of hearing aid devices. One problem is the permanent skin penetration which requires a good hygienic control and has aesthetic limits. By implanting parts of the apparatus hygienic as well as cosmetic aspects can be improved. Such a device is described in U.S. Pat. No. 4,904,233. A similar implantable bone anchored apparatus is also described in "Hearing by Bone Conduction", Stefan Stenfelt, Chalmers University of Technology, 1999. It is also referred to our co-pending patent application PCT/SE01/01229 which relates to a hearing aid device which comprises an external part as well as an implantable part which is anchored on the outside of the skull bone so that it can be easily r placed without any advanced surgical operation.

A common feature for the hearing aid devices which have been described here is that vibratory generating means, vibrators, are required. Different types of vibrators are well known in the art. There are a number of known vibrator principles today. In traditional as well as in bone anchored hearing aid devices it is normally used a vibrator principle which was described by Bell already in 1876. There is a detailed description of this principle applied on a bone anchored hearing aid device in "On Direct Bone Conduction Hearing Devices", Technical Report No. 195, Department of Applied Electronics, Chalmers University of Technology, 1990.

It is also referred to Swedish Patent No. 85.02426-3 which describes a vibrator having means for damping the natural frequency of the vibrator.

In headphones for air conduction hearing aids any type of the so-called "Balanced Armature" principle is often used, see for instance U.S. Pat. No. 905,781, Baldwin 1908. Even the so-called Moving coil principle, known from conventional loud-speakers, could be used.

For vibrators used for bone conduction hearing aid devices there are specific requirements. The vibrators should be powerful enough for transmitting the vibrations to the skull bone and forward the vibrations through the skull bone to the inner ear without any surgical operation in the bone. If a part of the hearing aid device is implantable onto the skull bone the vibrator should be as small and compact as possible.

The existing vibrator types like Bell, Balanced armature, Floating mass and Moving coil principles can be used also in this type of implantable bone conduction hearing aid devices, but they do not always give an optimal function for this specific application.

SUMMARY OF THE INVENTION

It is an object of the present invention to provide a vibrator device which is powerful enough, but at the same time has a small energy consumption and has small dimensions. The vibrator device is based on the principle that the static and dynamic magnetic fields are separated as far as possible and that the dynamic field does not pass through the permanent magnets in the vibrator.

The invention is mainly characterized by two permanent magnets which are working independently from each other in a magnetic circuit so that the static and dynamic magnetic fields are substantially separated from each other, whereby the static field is passing through only a part of the vibrator device and provides an axial force.

According to a preferred embodiment the magnetic circuit is formed as a casing around the vibrator device which casing protects the vibrator and reduces magnetic leakage.

BRIEF DESCRIPTION OF THE DRAWINGS

In the following the invention will be described more in detail with reference to the accompanying drawings, in which.

DETAILED DESCRIPTION OF EMBODIMENTS OF THE INVENTION

Figure 1A:
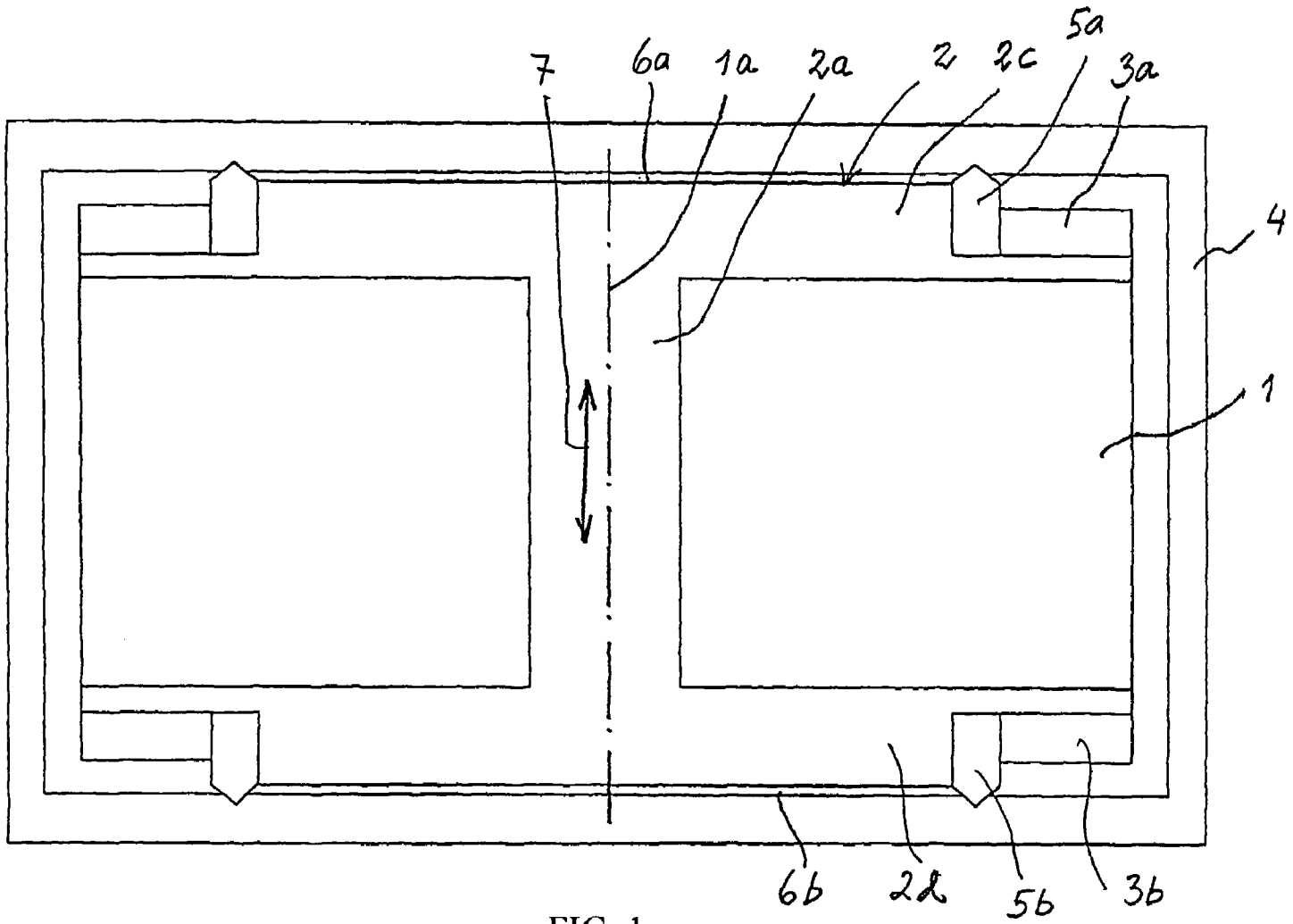
FIG. 1*a* is a cross-sectional view of a first embodiment of the vibrator.
Figure 1B:
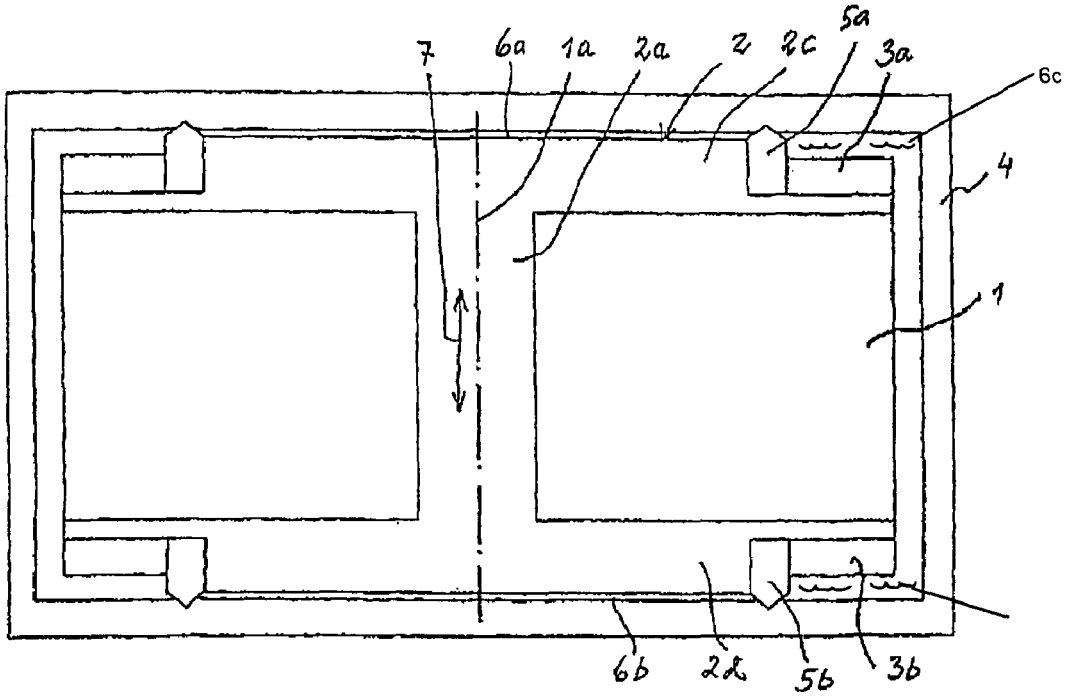
FIG. 1*b* is a cross-sectional view of a second embodiment of the vibrator.
Figure 1C:
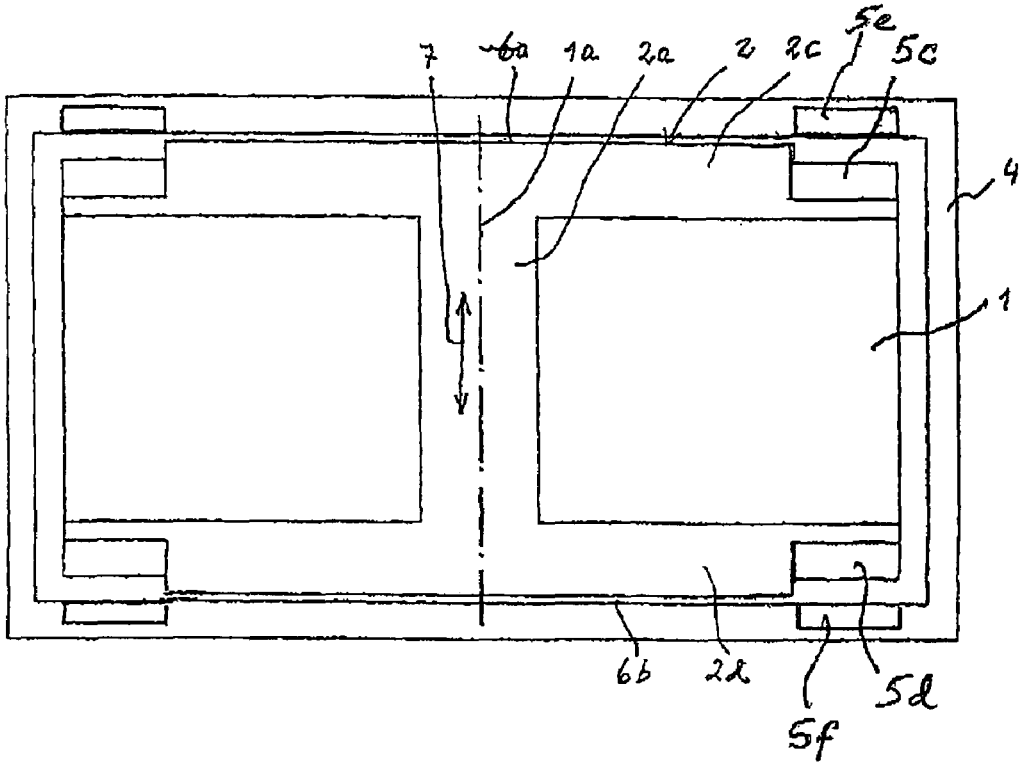
FIG. 1*c* is a cross-sectional view of a third embodiment of the vibrator.

As all of the embodiments of the vibrator are rotation symmetrical only one half of each vibrator device is shown in the figures, except from FIG. 1. FIG. 1 shows a cross-section through the centre axis 1*a* of a first embodiment of the vibrator. The vibrator comprises a coil 1 which is wound around a bobbin base 2 with a core 2*a* and two side walls 2*c*, 2*d*. In the two side walls there are two outer, peripherally located, annular recesses in which two axially magnetized annular permanent magnets 3*a*, 3*b* are attached. The entire coil and magnet arrangement is housed in a casing 4 which forms a part of the magnetic circuit and protects the vibrator and reduces magnetic leakage. The bobbin base and the casing are made of a material with high magnetic conductivity. Inner spring mechanisms 5*a*, 5*b* are arranged between the side walls of the bobbin base and the casing so that the coil and magnet arrangement is centered in the casing in its rest position with two air gaps 6*a*, 6*b* of the same size between the side walls and the casing. It is not necessary that the spring mechanisms are preloaded. In order to damp the vibratory movements of the coil arrangement the inner spacing of the vibrator can be filled with a suitable liquid 6*c*.

Instead of mechanically arranged spring mechanisms the vibrator coil could be centered magnetically by means of annular, repelling magnets 5*c*, 5*d* and 5*e*, 5*f* arranged on the outer side of the bobbin wall and opposite side of the casing, respectively, see FIG. 1*b*.

Figure 2:
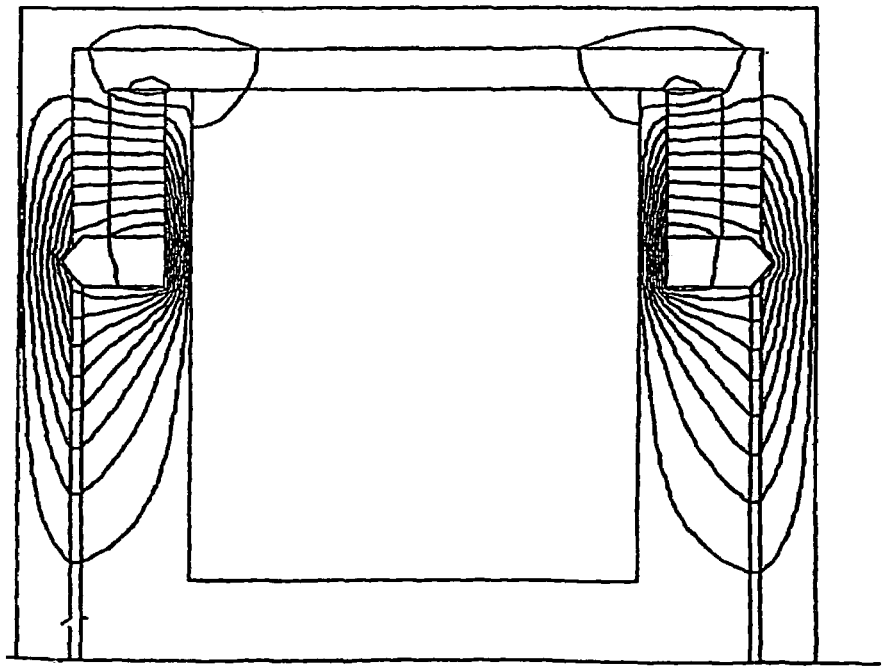
FIG. 2 shows the static magnetic field of the vibrator.

The two permanent magnets 3*a*, 3*b* are working independent from each other and generates a static magnetic field which is illustrated in FIG. 2. As shown in the figure the magnetic field is passing through only a part of the construction and the air gaps 6*a*, 6*b*, but not through the core 2*a* of the coil.

Figure 3:
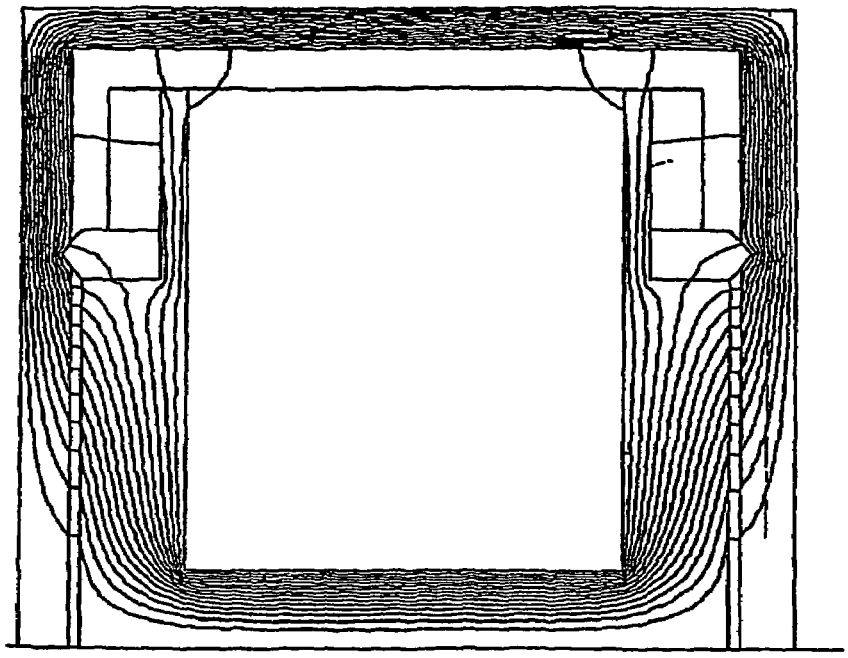
FIG. 3 shows the dynamic magnetic field of the vibrator.

When an alternating current is passing through the coil 1 a dynamic magnetic field is generated as illustrated in FIG. 3. As shown in the figure a substantial part of the vibrator is passed through only by the dynamic magnetic field, except from the permanent magnets, and as the dynamic magnetic field is small compared to the static field these parts of the vibrator can be made with smaller dimensions (thinner) as the required material thickness is proportional to the strength of the magnetic field. Furthermore these parts can be made of a material which is more suitable for alternating fields. Consequently a substantial part of the vibrator volume can be used for the power generating coil. The power is generated in the air gaps 6*a*, 6*b* between the bobbin and the casing when a current is passing through the coil. As already mentioned, in the rest position the air gaps have the same size; no static force is acting and the inner spring mechanism does not need to be pre-loaded. In operation the coil 1, the bobbin 2 and the annular magnets 3*a*, 3*b*, i e the entire coil and magnet assembly, is moved relative to the casing so that an axial force is obtained as indicated by the arrow 7 in FIG. 1. The inner spring mechanism 5*a*, 5*b* is chosen in such a way that a satisfactory resonant frequency is obtained from an audiological and effectiveness point of view.

By this vibrator design the dynamic and static magnetic fields are substantially separated from each other. However, they are coinciding in that part of the vibrator device where it is desirable for the power generation that the fields are coinciding, i e in the air gaps 6*a*, 6*b*.

Figure 4:
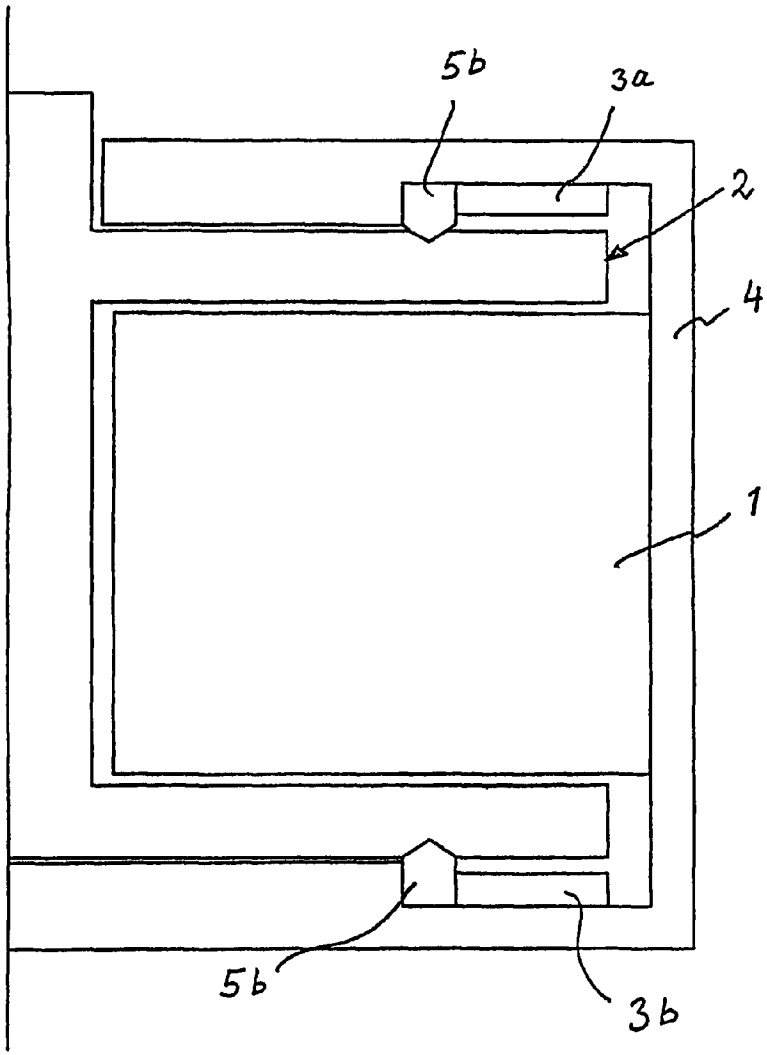
FIG. 4 shows a second embodiment in which the annular permanent magnets and the coil are attached to the casing.
Figure 6:
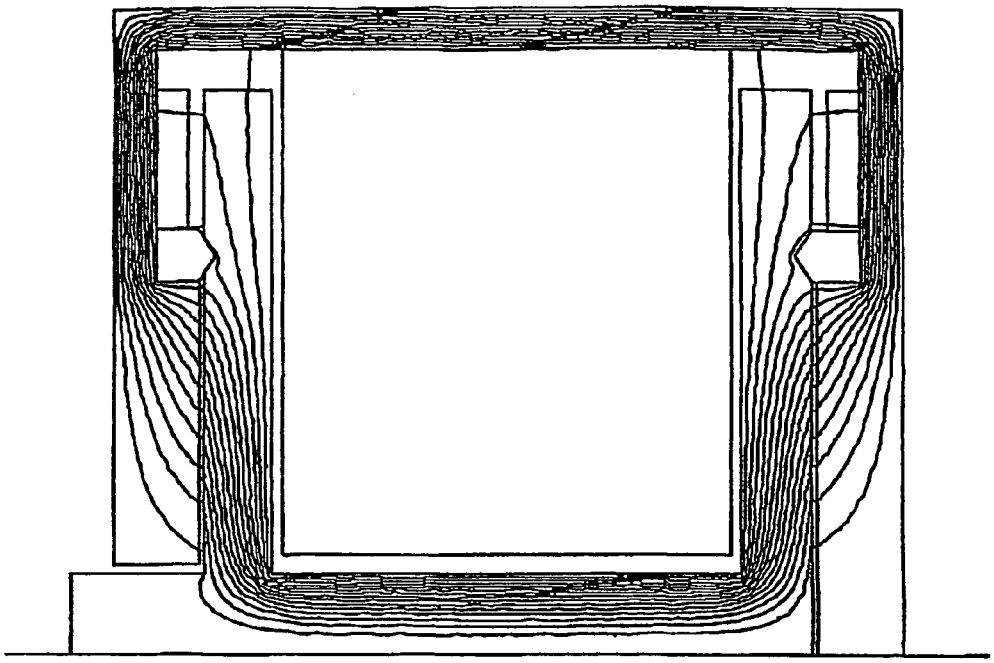
FIG. 6 shows the dynamic magnetic field of this vibrator.
Figure 5:
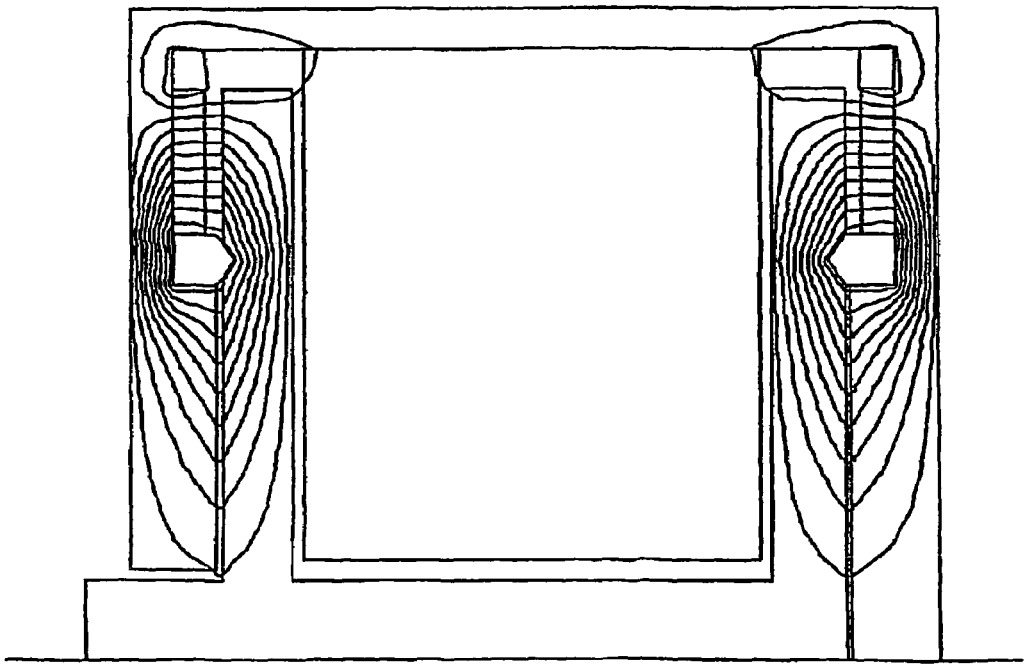
FIG. 5 shows the static magnetic field of this vibrator.

In FIG. 4 another example of a vibrator design is illustrated in which the annular permanent magnets 3*a*, 3*b* and the coil 1 instead are attached to the casing 4. The vibrator force is obtained through the bobbin 2 which is allowed to project out from the casing. Similar to the first embodiment the two annular permanent magnets 3*a*, 3*b* are working independent from each other and are generating a static magnetic field according to FIG. 5. When an alternating current is passing through the coil 1 a dynamic field is generated as illustrated in FIG. 6. The static and the dynamic magnetic fields are substantially separated from each other, but the fields are coinciding in that part of the vibrator where it is desired with such coinciding fields, i e in the air gaps.

It should be understood that there might be hybrids between these two design solutions so that each of the coil and annular magnets are attached to either the bobbin or casing.

Figure 7:
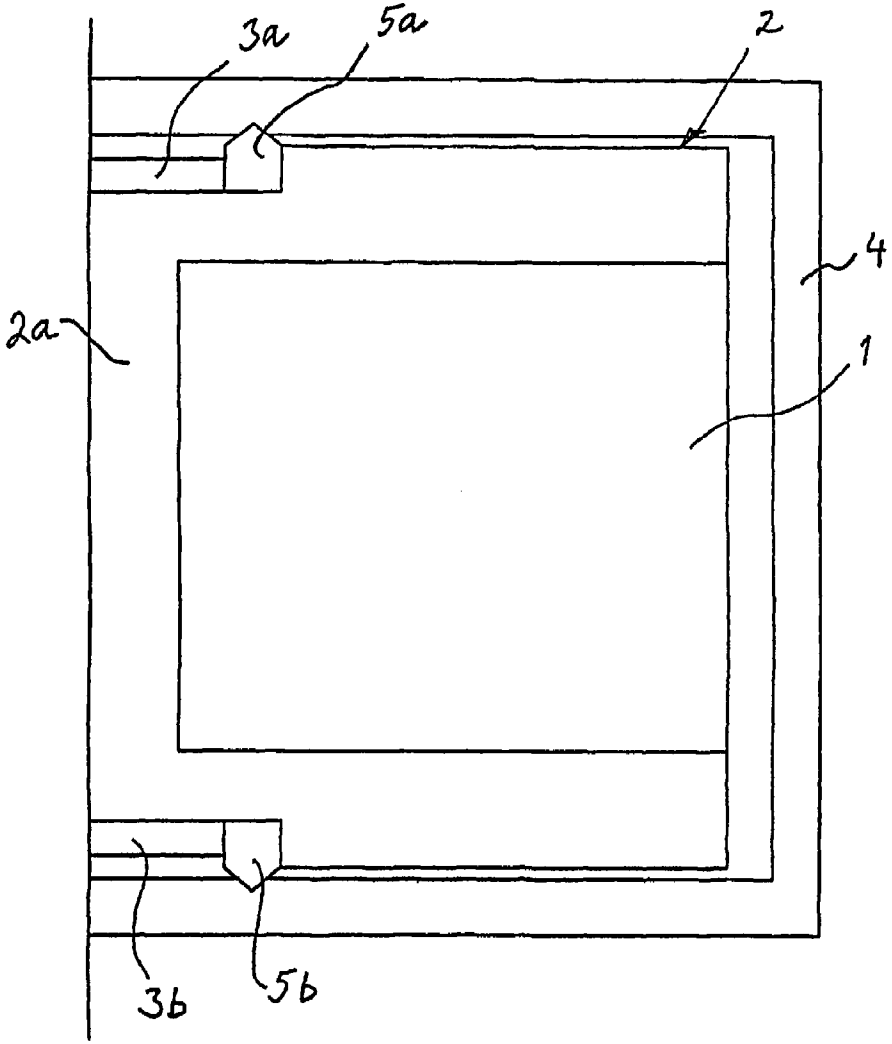
FIG. 7 shows a third embodiment with axially magnetized disc-shaped magnets.

In FIG. 7 a third vibrator device is shown which also comprises two permanent magnets like the first examples. In contrast to the peripherally arranged, annular permanent magnets illustrated in the two first embodiments, in this case the axially magnetized permanent magnets 3*a*, 3*b* are located centrally. They are each arranged in its own centrally located recess in the outer side of the bobbin wall, adjacent to core 2*a* of the coil and they are disc-shaped (puck-shaped).

Figure 9:
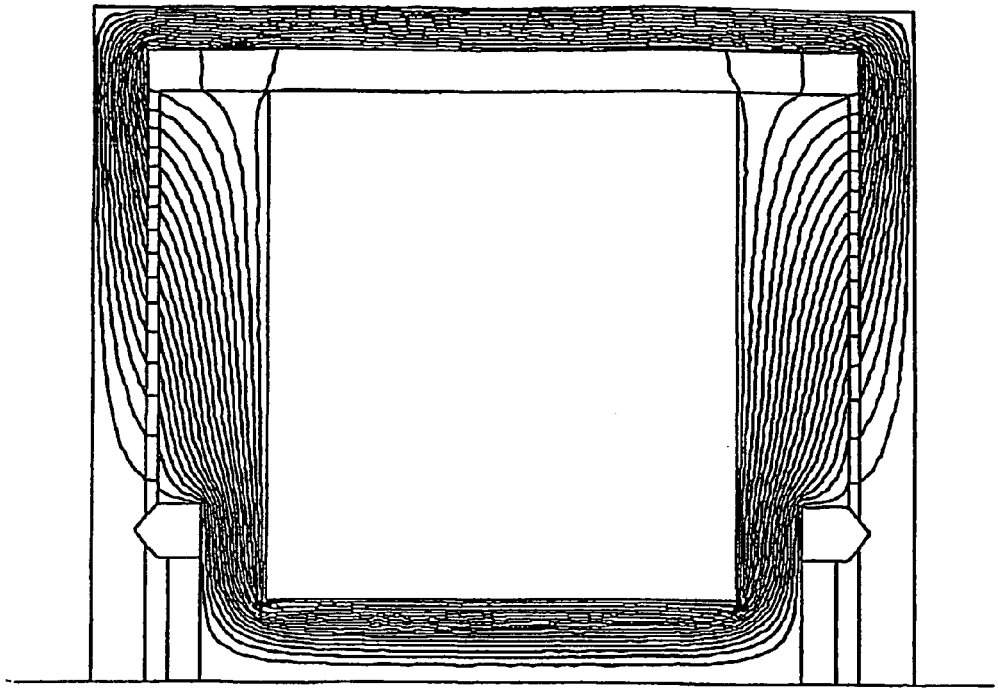
FIG. 9 shows the dynamic magnetic field for this embodiment.
Figure 8:
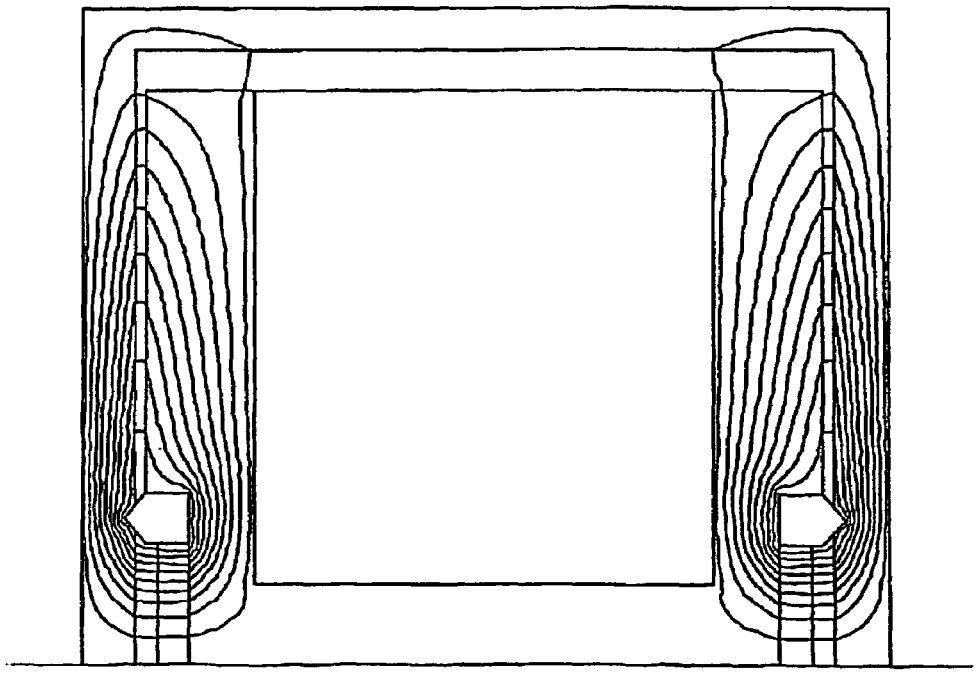
FIG. 8 shows the static magnetic field for this embodiment.

The static and dynamic magnetic fields generated by this third embodiment are illustrated in FIGS. 8 and 9. Again, it should be clear that the magnetic fields are substantially separated, but they coincide where this is best needed, i. e. in the air gaps. Specifically, the static field only goes through a part of the construction and the dynamic field does not go through the permanent magnets.

Figure 10:
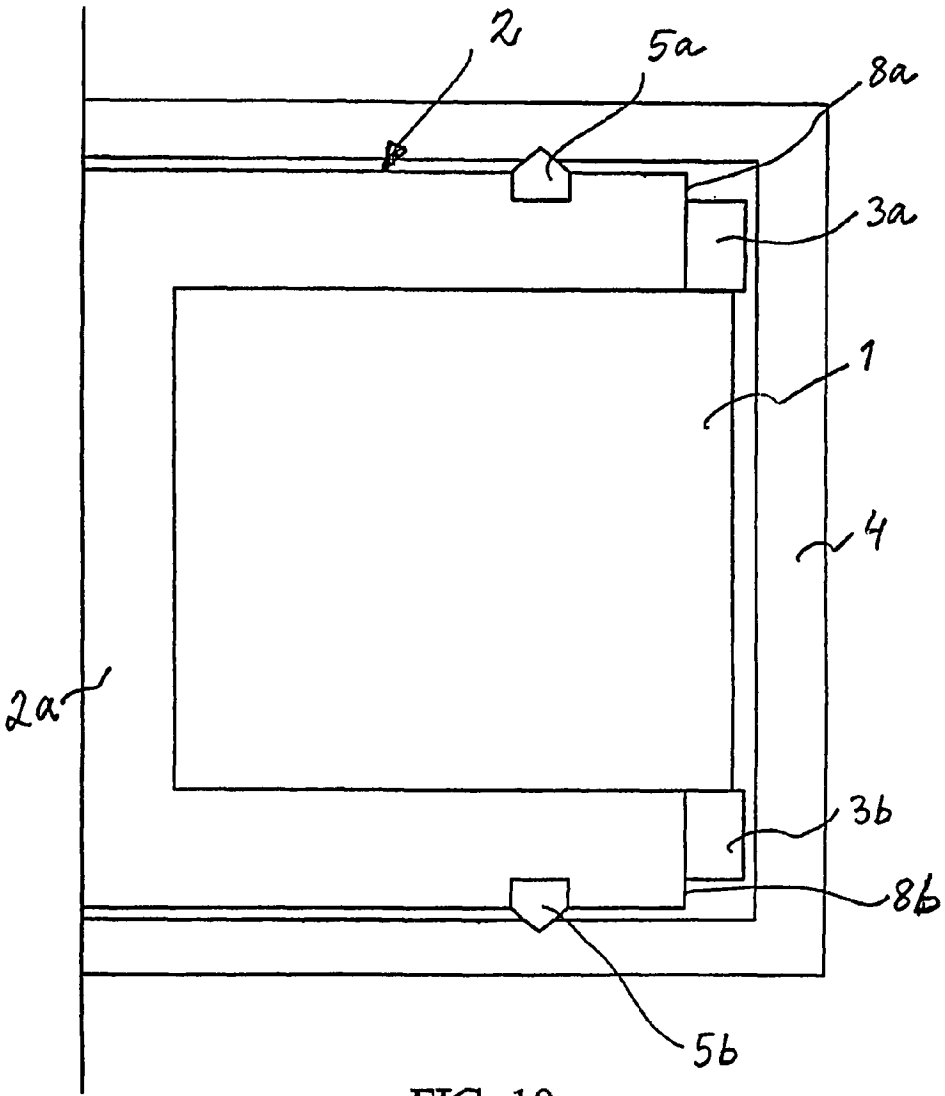
FIG. 10 shows a fourth embodiment with radially magnetized permanent magnets.
Figure 12:
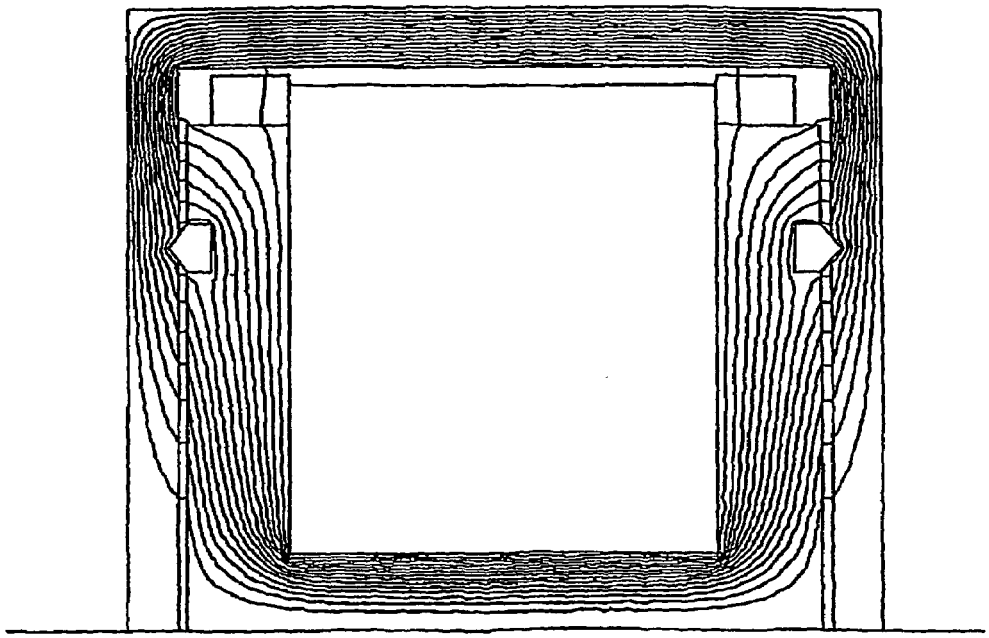
FIG. 12 shows the dynamic magnetic field for this fourth embodiment.
Figure 11:
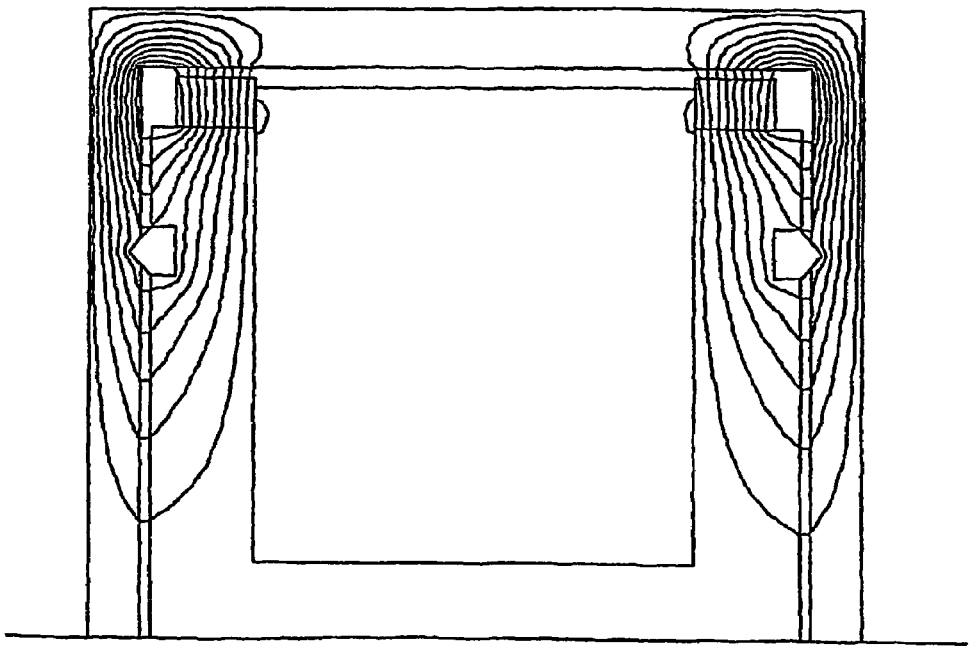
FIG. 11 shows the static magnetic field for this fourth embodiment.

In the embodiments which have been illustrated so far the permanent magnets are axially magnetized. In FIG. 10 there is an example where the permanent magnets 3*a*, 3*b* are radially magnetized. The magnets are annular and arranged on the end surfaces 8*a*, 8*b* of the side walls of the bobbin. Even in this case the static and dynamic fields are separated, as illustrated in FIGS. 11 and 12. Specifically, the static field does not in any case go through the core 2*a* of the coil. The casing 4 protects the entire construction.

As mentioned by way of introduction the vibrator is specifically intended to be used in connection with a bone conduction hearing aid device. In case of conventional bone conduction the casing 4 of the vibrator is resting directly against the skull of the patient. In case of a bone anchored, bone conduction hearing aid coupling means are arranged on the casing for connection to an implant, for instance a titanium screw, a so-called fixture, anchored in the skull bone. In case of an implanted bone conductor the vibrator is used with or without coupling means depending on the implant method.

The invention is not limited to the embodiments illustrated in the figures but can be varied within the scope of the accompanying claims. Specifically it should be understood that there could be hybrids between the different embodiments.

The invention claimed is:

1. A vibrator for bone conduction type hearing aid devices, comprising:

a coil for generating a dynamic magnetic field;

permanent magnet means for generating a static magnetic field in a magnetic circuit, wherein the permanent magnet means comprises two permanent magnets that work independently from each other in the magnetic circuit and are arranged such that the static and dynamic magnetic fields are substantially separated from each other, whereby the static field passes through only a part of the magnetic circuit and whereby the vibrator provides an axial force;

a casing enclosing the coil and magnet arrangement, wherein the casing forms a part of the magnetic circuit and protects the vibrator and reduces magnetic leakage, wherein the static and dynamic magnetic fields coincide in the air gaps formed between the coil and magnet arrangement and the casing; and inner spring means arranged between the coil and magnet means and the casing so that the coil and magnet means in its rest position is centered in the casing between two air gaps of the same size.

2. The vibrator according to claim 1, further comprising:

a liquid filling the vibrator and operative to damp vibratory movements of the coil and magnet means.

3. The vibrator according to claim 1, wherein the coil and permanent magnets are attached to the casing, and wherein the axial force from the vibrator is obtained through the coil bobbin, which protrudes the casing.

4. The vibrator according to claim 1, further comprising:

a bobbin base around which the coil is wound, the bobbin base comprising a core and two side walls including end surfaces on which the two permanent magnets are arranged.

5. The vibrator according to claim 4, wherein the permanent magnets are annular and radially magnetized.

6. A vibrator for bone conduction type hearing aid devices, comprising:

a coil for generating a dynamic magnetic field;

permanent magnet means for generating a static magnetic field in a magnetic circuit, wherein the permanent magnet means comprises two permanent magnets that work independently from each other in the magnetic circuit and are arranged such that the static and dynamic magnetic fields are substantially separated from each other, whereby the static field passes through only a part of the magnetic circuit and whereby the vibrator provides an axial force;

a casing enclosing the coil and magnet means, wherein the casing forms a part of the magnetic circuit and protects the vibrator and reduces magnetic leakage, wherein the static and dynamic magnetic fields coincide in the air gaps formed between the coil and magnet means and the casing; and repellent magnets arranged in the coil and magnet means and in opposite parts of the casing such that the coil and magnet means in its rest position is centered in the casing between two air gaps of the same size.

7. The vibrator according to claim 6, further comprising:

a liquid filling the vibrator and operative to damp vibratory movements of the coil and magnet means.

8. The vibrator according to claim 6, wherein the coil and permanent magnets are attached to the casing, and wherein the axial force from the vibrator is obtained through the coil bobbin, which protrudes the casing.

9. The vibrator according to claim 6, further comprising:

a bobbin base around which the coil is wound, the bobbin base comprising a core and two side walls including end surfaces on which the two permanent magnets are arranged.

10. The vibrator according to claim 9, wherein the permanent magnets are annular and radially magnetized.

11. A vibrator for bone conduction type hearing aid devices, comprising:

a coil for generating a dynamic magnetic field;

permanent magnet means for generating a static magnetic field in a magnetic circuit, wherein the permanent magnet means comprises two permanent magnets that work independently from each other in the magnetic circuit and are arranged such that the static and dynamic magnetic fields are substantially separated from each other, whereby the static field passes through only a part of the magnetic circuit and whereby the vibrator provides an axial force;

a bobbin base around which the coil is wound, the bobbin base comprising a core and two side walls including two outer recesses in which the two permanent magnets are attached.

12. The vibrator according to claim 11, wherein the permanent magnets are axially magnetized.

13. The vibrator according to claim 11, wherein the two recesses are annular and arranged peripherally for attachment of two annular permanent magnets.

14. The vibrator according to claim 11, wherein the two recesses are centrally located for attachment of two disc shaped permanent magnets.

15. The vibrator according to claim 11, wherein the permanent magnets are annular and radially magnetized.

16. A vibrator for bone conduction type hearing aid devices, comprising:

a coil for generating a dynamic magnetic field;

permanent magnet means for generating a static magnetic field in a magnetic circuit, wherein the permanent magnet means comprises two permanent magnets that work independently from each other in the magnetic circuit and are arranged such that the static and dynamic magnetic fields are substantially separated from each other, whereby the static field passes through only a part of the magnetic circuit and whereby the vibrator provides an axial force, wherein the magnetic circuit is arranged in such a way that the static magnetic field does not pass through core of the coil and that the dynamic magnetic field does not pass through the permanent magnets.

* * * * *